United States Patent [19]

Maekawa et al.

[11] 3,994,731

[45] Nov. 30, 1976

[54] AZO DYE DEVELOPERS COMPRISING FURAN RINGS

[75] Inventors: Yukio Maekawa; Shinsaku Fujita; Kazuya Sano; Seiki Sakanoue, all of Minami-ashigara, Japan

[73] Assignee: Fuji Photo Film Co., Ltd., Minami-ashigara, Japan

[22] Filed: July 8, 1974

[21] Appl. No.: 486,730

[30] Foreign Application Priority Data

July 6, 1973 Japan ..... 48-76226

[52] U.S. Cl. ..... 96/73; 96/3; 96/29 D; 96/77; 96/99

[51] Int. Cl.[2] ..... G03C 1/76; G03C 1/40; G03C 7/00; G03C 1/10

[58] Field of Search ..... 96/3, 29 D, 77, 99, 96/73

[56] References Cited

UNITED STATES PATENTS

| | | | |
|---|---|---|---|
| 3,134,672 | 5/1964 | Blout et al. | 96/3 |
| 3,307,947 | 3/1967 | Idelson et al. | 96/3 |
| 3,415,646 | 12/1968 | Land | 96/3 |

*Primary Examiner*—David Klein
*Assistant Examiner*—Richard L. Schilling
*Attorney, Agent, or Firm*—Sughrue, Rothwell, Mion, Zinn & Macpeak

[57] ABSTRACT

A dye developer represented by the following general formula (I), (I)

wherein X is a hydrogen atom, a bromine atom, a nitro group, an acylamino group, a hydroxyl group or an alkyl group having not more than 4 carbon atoms; *n* is 1, 2 or 3; Y is an acyl group having not more than 4 carbon atoms; and Ar is a mono- or polyaryl group; and wherein an aromatic ring can be condensed in the 4-and 5-positions of the furan ring nucleus, and at least one of X, the aromatic ring condensed with the furan ring nucleus and Ar being directly connected to or being connected through an atom or an atomic grouping to a polyphenol having developing activity for silver halide.

10 Claims, 4 Drawing Figures

AZO DYE DEVELOPERS COMPRISING FURAN RINGS

BACKGROUND OF THE INVENTION

1. Field of the Invention

The present invention relates to a dye developer useful for light-sensitive materials capable of forming color images by the diffusion transfer process and, more particularly, it relates to a precursor of a yellow dye developer, which is hydrolyzed in alkaline solution to form a yellow color dye.

2. Description of the Prior Art

A diffusion transfer process utilizing a dye developer is well known in the photographic art (for example, as disclosed in U.S. Pat. Nos. 3,201,384 and 3,246,985).

The dye developer, as noted in U.S. Pat. Nos. 3,201,384 and 3,246,985, is a compound which contains, in the same molecule, both a group capable of developing a silver halide and a chromophoric system of a dye, and which can be immobilized in the amount corresponding to the amount of developed silver halide and of which the residual amount can be transferred to an image-receiving layer to form transferred dye images.

When a hydrophilic colloid layer (e.g., a gelatin layer) containing the dye developer is provided at the photoexposure side to the light-sensitive emulsion layer having substantial spectral sensitivity in the spectral region of the dye (developer) or the dye developer is included in the light-sensitive emulsion layer, the light-sensitive emulsion is seemingly desensitized by the light-absorption of the dye developer. In order to prevent the desensitization of the silver halide emulsion, a proposal has been made that the dye developer be chemically modified and converted into a compound whose spectral absorption region has been relocated at substantially shorter wavelengths for at least the time interval necessary to accomplish photoexposure of the light-sensitive emulsion and which, however, reacts with a processing solution during processing to subject the compound to a restoration of the original absorption characteristics of the dye developer. Such a dye developer is defined as a "temporarily shifted dye developer" in the specification.

However, since a temporarily shifted yellow dye developer is processed in an alkali processing solution to produce a carboxyl group, simultaneously, the quinone form of the dye developer produced in the exposed portions as a result of is development is incompletely immobilized, and therefore, unavoidably an undesirable amount of the dye is transferred to cause a so-called "leak" in the light portions of the dye images.

The temporary shift of the dye developer can be generally attained by acylation of the auxchromic hydroxy or amino group of an azo dye. Since an azo dye can form two tautomers which are a hydrogen type with an absorption at comparatively longer wagelength side and an azo type with an absorption at shorter wavelength side, the temporary shift can be attained by acylation of the azo type tautomer.

A dye useful for desirable dye developer should satisfy the conditions that the absorption after the restoration is a desirable yellow color, that the absorption of the temporarily shifted dye is in a sufficiently shorter wavelength region so that the sensitivity of the emulsion is not affected thereby, that the restoration occurs rapidly due to the action of a processing solution, and that the restoration does not occur during the storage of the light-sensitive materials.

However, although conventional yellow azo dyes give preferred light absorption, conventional yellow azo dyes are insufficient as dyes for desirable dye developers, because, for example, pyrazolone azo dyes, 3-allylazo-2,4-dihydroxyquinoline and 2-allylazo-1,3-indanedion can not be acylated or can be acylated only with extreme difficulty; pyrazolobenzimidazole azo dyes and pyrimidazolone azo dyes can be acylated but the temporary shift is insufficient; or aniline type azo dyes can be acylated but the restoration can not be achieved by the processing solution.

SUMMARY OF THE INVENTION

Therefore, an object of the invention is to provide a dye developer which satisfies the above requirements and which does not deteriorate the spectral sensitivity of light-sensitive emulsions.

It has been found that the above object of the invention can be accomplished using a compound having the following general formula (I),

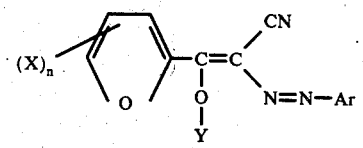

(I)

wherein X is a hydrogen atom, a bromide atom, a nitro group, an acylamino group (e.g., having less than 10 carbon atoms in the acyl moiety such as an acetylamino group), a hydroxyl group or an alkyl group having not more than 4 carbon atoms (e.g., an unsubstituted alkyl group such as a methyl group or an ethyl group; a substituted alkyl group such as an alkoxyalkyl group (such as a methoxyethyl group or an ethoxyethyl group)), and, in addition to the X substituent, in the 4- and 5-position of the furan ring, there can be condensed an aromatic ring such as a benzene ring, which can be substituted with an alkyl group of not more than 4 carbon atoms such as a methyl group, a nitro group, an acylamino group, e.g., having less than 10 carbon atoms in the acyl moiety, a halogen atom such as a chlorine atom or a bromide atom, or an alkoxy group of not more than 4 carbon atoms such as a methoxy group, but the kind of the substituents is not important and can vary widely; n is 1, 2 or 3; Y is an acyl group of not more than 4 carbon atoms (e.g., an acetyl group, a hydroxyacetyl group, an alkoxyacetyl group (such as a methoxyacetyl group) or a butyryl group); Ar is a mono or polyaryl group (e.g., a phenyl group, a naphthyl group, etc.), which can be substituted with a halogen atom such as a chlorine atom or a bromine atom, an alkyl group of not more than 4 carbon atoms such as a methyl group or an alkoxy group of not more than 4 carbon atoms; at least one of X, the aromatic ring condensed with the furan ring nucleus and Ar being connected directly or through an atom or atomic group to a developing active polyphenol, for example, hydroquinone or catechol, or to an acylated form thereof (e.g., having less than 8 carbon atoms in the acyl moiety such as an acetylated compound, a butyrated compound, oxyarylated compound or formylated compound) capable of generating hydroquinone in the processing solution.

BRIEF DESCRIPTION OF THE DRAWINGS

In FIG. 1, the continuous line is obtained in 100 ml of acetone containing 2.11 mg of Compound 1, and the dotted line is obtained in 100 ml of acetone containing 2.11 mg of Compound 1 and 0.2 vol% of a 0.1 N sodium hydroxide aqueous solution.

DETAILED DESCRIPTION OF THE INVENTION

Figure 1:
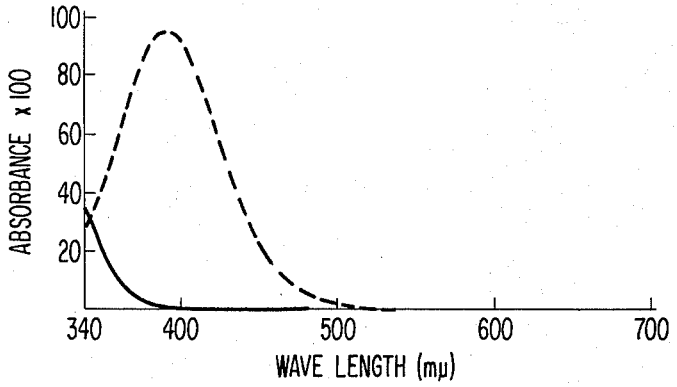
FIG. 1 shows the spectral absorption curves measured in acetone containing Compound 1 of the invention and in acetone further containing an alkali.

Some embodiments of the dye developers in the invention are illustrated below in greater detail.

If a benzene ring is condensed in the 4- and 5-position of a furan ring nucleus, the color hue tends to be more preferable but the transferring property thereof is reduced with an increase of molecular weight of the dye. The substituent on the condensed benzene ring does not influence the color hue.

If the furan ring is substituted with a thiophene ring, the color hue of the dye is shifted to a shorter wavelength region. An acetyl group as Y is inexpensive. However, it is possible to use a group of a glycolic acid derivative such as a methoxyacetyl group as Y in order to increase the transferring property, or to use a butyryl group as Y in order to control the restoration rate of the dye.

Suitable atoms or atomic groupings linking the compound of the general formula (I) to the developing active polyphenol are an oxygen atom, a sulfur atom, a methylene group, an alkylene group having less than 5 carbon atoms. It is not important in the invention how the dye portions are connected to the developing active polyphenol, for example, hydroquinone. Although the dye portion can be directly connected to the compound, it is preferred from the standpoint of developing activity that the dye be connected to the polyphenol through a methylene group, or alkylene groups having not more than 4 carbon atoms, which is directly connected to the polyphenol.

Typical examples of the dye developers of the invention are shown below:

Compound 1

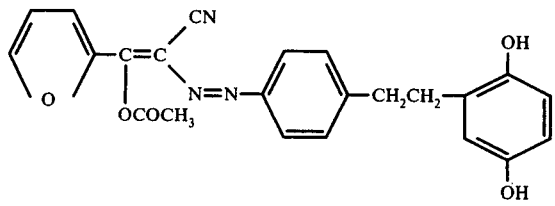

Compound 2

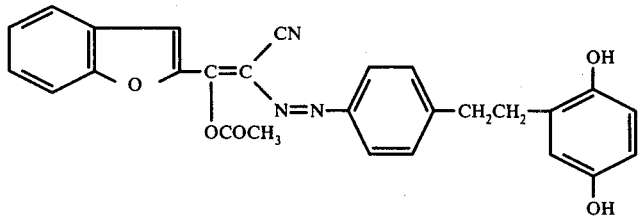

Compound 3

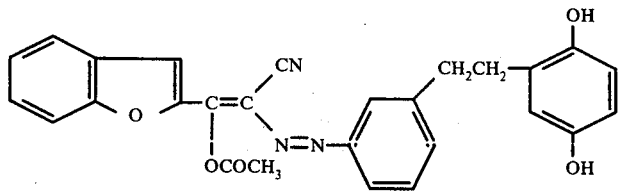

Compound 4
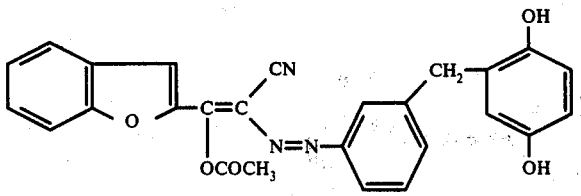
Compound 5
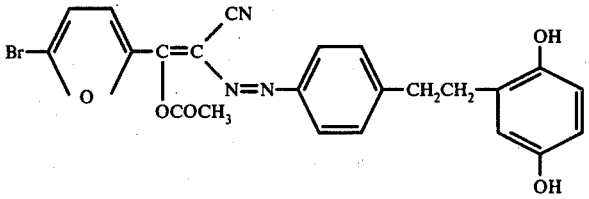
Compound 6
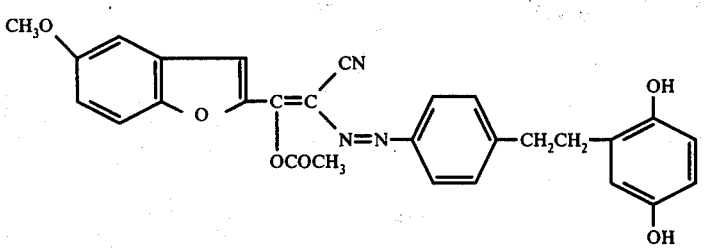
Compound 7
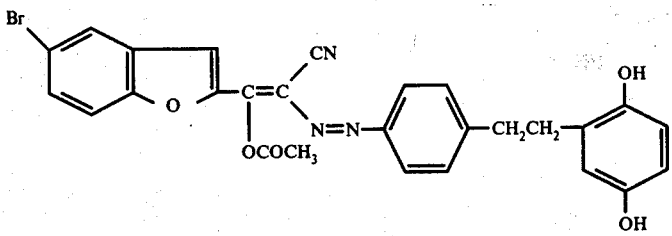
Compound 8
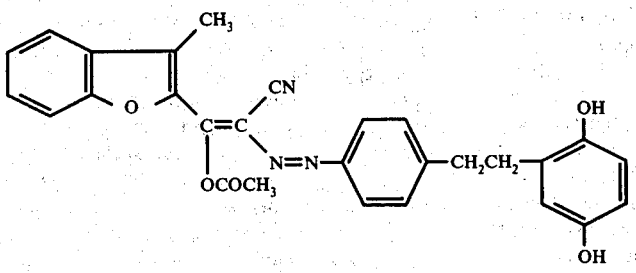
Compound 9
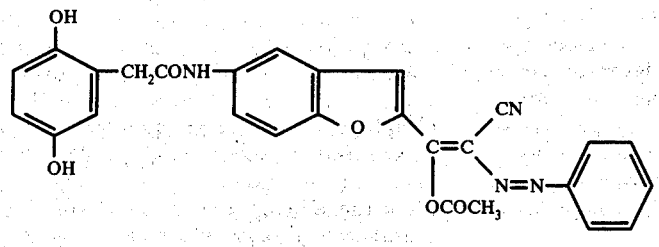

Compound 10

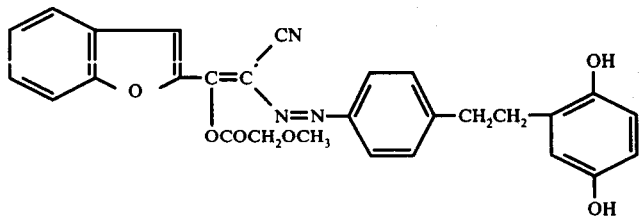

Compound 11

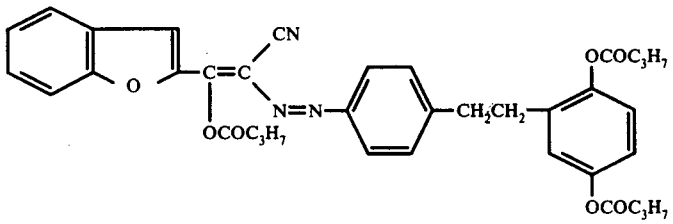

Compound 12

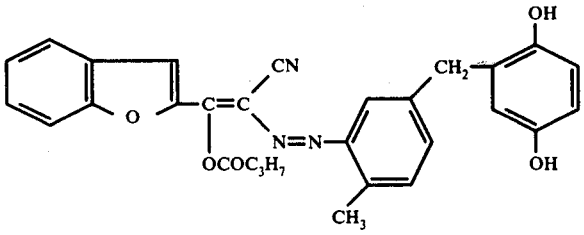

These dye developers are useful for light-sensitive materials in which the image-receiving elements after the transfer of the dye developers are stripped from the negative elements to obtain photographs and are more useful for light-sensitive materials which form photographic images without stripping the image-receiving elements from the negative elements as disclosed in U.S. Pat. Nos. 3,415,644; 3,415,645; and 3,415,646. Particularly, non-stripping type light-sensitive materials which can form photographic images observed from the opposite side to the exposure side are better than light-sensitive materials which can form photographic images observed from the exposure side because optical reversal operations are unnecessary in a camera, and in such photographic materials, it is the very significant to use the temporarily shifted dye developer because it is important that the receiving layer, the space for flowing the processing solution, the blue-sensitive layer and the hydrophilic colloid layer containing the yellow dye developer be arranged in order for obtaining preferable color separation and that the exposure be carried out from the side near the layer containing the dye developer.

Light-sensitive materials for the color diffusion transfer process are composed of a silver halide emulsion and a dye developer in combination. The combination of the spectral sensitivity of the silver halide emulsion and the spectral absorption of the dye image can be appropriately selected corresponding to the desired color reproduction. In subtractive color reproductions, light-sensitive elements comprising at least two combinations of a silver halide emulsion having a selective spectral sensitivity in some spectral range and a compound capable of forming a dye image having a selective spectral absorption in the same spectral range can be used. Particularly, light-sensitive elements are advantageous which comprise a combination of a blue-sensitive silver halide emulsion and a yellow dye developer, a combination of a green-sensitive emulsion and a magenta dye developer, and a combination of a red-sensitive emulsion and a cyan dye developer. These combinations of emulsion and dye developer can be in a face to face relationship in the layers in the light-sensitive elements or can be a mixture in the form of particles thereof as a layer. In a preferred embodiment of a superposed relationship, a blue-sensitive emulsion, a green-sensitive emulsion and a red-sensitive emulsion are arranged from the side of exposure, in order, and particularly in case of using a high speed emulsion containing silver iodide, a yellow filter layer can be advantageously provided between the blue-sensitive emulsion and the green-sensitive emulsion. The yellow filter layer contains a yellow colloidal silver dispersion, a dispersion of an oil-soluble yellow dye, an acidic dye mordanted in a basic polymer or a basic dye mordanted in an acidic polymer. It is advantageous that the emulsion layers be separated by an interlayer which prevents undesirable interactions between the emulsion layers having different spectral sensitivities. The intermediate layer can contain a hydrophilic polymer such as gelatin, polyacrylamide or partially hydrolized polyvinyl acetate, a polymer having a micelle formed by the latex of a hydrophilic polymer and a hydrophobic polymer as disclosed in U.S. Pat. No. 3,625,685, or a polymer such as calcium alginate, of which the hydrophilic property is gradually increased by the processing composition as disclosed in U.S. Pat. No. 3,384,483.

A silver halide emulsion used in the invention is a hydrophilic colloid dispersion of a silver halide such as silver chloride, silver bromide, silver iodide, silver chlorobromide, silver iodobromide, silver chloroiodobromide or mixture thereof, and the halide ratio in the emulsion can be widely selected depending on the end use purposes of the light-sensitive materials and the processing conditions employed. A silver iodobromide emulsion of silver chloroiodobromide emulsion which contains about 1 to 10 mol % of iodide, (30 mol % or less of chloride), and the remaining amount of bromide is preferred. The particle size of silver halide can be that conventionally employed or a fine particle size, preferably a size ranging from about 0.1 to about 2 microns. In some cases, a uniform particle size is often desired. The crystal shape of silver halide can be cubic, octahedral or mixture of shapes. These silver halide emulsions can be prepared using conventional preparation methods, for example, as disclosed in P. Glafkides, *Chimie Photographique*, 2nd Edition, Chapters 18 to 23, Paul Montel., Paris (1957). That is, a water soluble silver salt such as silver nitrate and a water soluble halide such as potassium bromide are reacted in the presence of an aqueous solution of a hydrophilic protective colloid such as gelatin or polyvinyl alcohol, and the thus prepared silver halide is ripened in the presence of an excess amount of halide or in a silver halide solvent such as ammonia to increase the average grain size. In this case, the precipitation can be carried out using the single-jet method, the double-jet method or the pAg controlled double-jet method. The removal of a water soluble salts from the emulsion can be achieved by washing the emulsion gelled under cooling, dialysizing the water soluble salts, coagulating the emulsion with a coagulating agent such as an anionic polymer or an anionic surface active agents having a sulfone group, a sulfuric acid ester or a carboxyl group together with pH adjustment, or coagulating the emulsion containing acylated proteins, e.g., phthalated gelatin, as the protective colloid with pH adjustment. It is preferred that the silver halide emulsion in the invention be chemically sensitized, e.g., with the natural chemical sensitizers contained in gelatin, a sulfur sensitizer as disclosed in U.S. Pat. No. 2,410,689 such as sodium thiosulfate or N,N,N-triethyl-thiourea, a gold sensitizer as disclosed in U.S. Pat. No. 3,503,749 such as aurous thiocyanate complex salt or aurous thiosulfate complex salt, a reducing sensitizer as disclosed in U.S. Pat. Nos. 2,518,689, 2,743,182, and 3,369,904 such as stannous chloride or hexamethylenetetramine under heating. Those silver halide emulsions capable of forming latent images on the surface of grains and silver halide emulsions capable of forming latent images in the inner portions of the grains as disclosed in U.S. Pat. Nos. 2,592,550 and 3,206,313 can be utilized in the invention. A suitable coating amount of the emulsion ranges from about 0.1 g/m² to 10 g/m², preferably 0.3 g/m² to 4 g/m², (as silver per m² of the support).

The silver halide emulsion in the invention can be stabilized with additives such as 4-hydroxy-6-methyl-1,3,3a,7-tetrazaindene, 5-nitroimidazole, 1-phenyl-5-mercaptotetrazole, 8-chloromercuryquinoline, benzenesulfinic acid, pyrocatechin, 4-methyl-3-sulfoethylazolidine-2-thione or 4-phenyl-3-sulfoethylthiazolidine. In addition to the above additives, inorganic compounds such as cadmium salts, mercury salts or complex salts of metals belonging to the platinum group of the Periodic Table such as palladium chloride complex salt can be advantageously used as the stabilizer. The silver halide emulsion in the invention can contain a sensitizing compound such as a polyethylene oxide.

The spectral sensitivity of the silver halide emulsion used in the invention can be increased with a spectral sensitizing dye, if desired. Useful spectral sensitizers are cyanine dyes, merocyanine dyes, holopolar cyanine dyes, styryl dyes, hemicyanine dyes, oxonol dyes and hemioxonol dyes. Typical examples of the spectral sensitizers are disclosed in the above-described *Chimie Photographique*, Chapters 35 to 41, and F. M. Hamer, *The Cyanine Dyes* and *Related Compounds* (Interscience). The cyanine dyes in which a nitrogen atom of the basic heterocyclic ring nuclei is substituted with an aliphatic group (e.g., an alkyl group) having a hydroxyl group, a carboxyl group or a sulfo group, as disclosed in U.S. Pat. Nos. 2,503,776; 3,459,553 and 3,177,210 are particularly useful in the invention.

The dye developer of the invention can be dispersed in a hydrophilic colloid as a carrier using conventional methods. That is, an organic solvent solution of the dye developer can be added to an aqueous solution of a hydrophilic colloid and then dispersed as fine particles. When a volatile solvent such as ethyl acetate, tetrahydrofuran or methyl ethyl ketone is used, it is removed in the step of drying the photographic layer or using the methods as disclosed in U.S. Pat. Nos. 2,322,027 and 2,801,171. When a water soluble solvent such as dimethylformamide or 2-methoxyethanol is used, it can be removed off by washing as disclosed in U.S. Pat. Nos. 2,949,360 and 3,396,027. Particularly, it is advantageous in order to stabilize the dispersion of dye developer and to accelerate the dye image formation that the dye developer be incorporated into a substantially water-insoluble solvent having a boiling point of higher than about 200° C at normal pressure. Examples of suitable solvents are dibutyl phthalate, tricresyl phosphate, trihexyl phosphate and N,N-diethyllauramide. In order to accelerate the dissolution of dye developer, it is preferred that a volatile or water soluble solvent be used as an auxiliary solvent.

Further, an oleophilic polymer can be used instead of the high boiling solvent or in combination with it. A colloid mill, a high pressure homogenizer and an ultrasonic emulsifying device can be used to disperse the dye developer, and in that case, an anionic surface active agent can be suitably used as an emulsifying agent. A suitable amount of the dye developer of this invention ranges from about 0.1 g/m² to 10 g/m², preferably 0.3 g/m² to 4 g/m², of the support.

The light-sensitive materials are arranged in superposed relationship with the image-receiving elements described below, and are treated by spreading an alkaline processing solution described below therebetween. After transferring the dye developer, the image-receiving elements are stripped off or are not stripped off. The latter system, as disclosed in U.S. Pat. No. 3,415,645, utilizes a transparent support and a reflection layer provided between the receiving layer and the light-sensitive layer, whereby the images can be observed without stripping the image-receiving elements.

The image-receiving element must have a mordant layer containing poly-4-vinylpyridine, a latex, polyvinyl alcohol, polyvinylpyrrolidone or a polymer containing a quarternary ammonium salt as disclosed in U.S. Pat. No. 3,239,337, and has preferably the function for neutralizing an alkali which is incorporated from the processing composition into the layer.

The processing composition has a pH sufficient to accelerate the image-forming steps including silver halide development and dye developer diffusion. Such the pH is higher than 10, preferably higher than 11. The processing composition contains an alkali such as sodium hydroxide, potassium hydroxide, etc., to provide the high pH. After the diffusion transfer images are substantially formed, the pH in the film unit is rendered neutral, that is, lower than a pH of about 9, preferably lower than a pH of 8, whereby the image-forming steps are substantially terminated and the changes of photographic properties with the lapse of time, for example, discoloration in image portions and generation of stain in the brown color portions and in the white background portions can be prevented. For these purposes, it is preferred that a neutralizing layer containing an acid substance in the amount sufficient to neutralize the alkali in the processing composition to the above pH range is associated with the film unit. The amount of acid substance in the neutralizing layer is, in other words, more than the equivalent amount of the alkali in the processing composition per unit area, e.g., more than about 1 : 1 up to about 2 : 1. Preferable acid substances are substances having an acid group with a pKa of not higher than about 9, preferably carboxyl group, sulfonic acid group or precursor group capable of forming these groups upon hydrolysis. More preferable acid substances are higher fatty acids such as the olefinic acid disclosed in U.S. Pat. No. 2,983,606, and acrylic acid polymers, methacrylic acid polymers or maleic acid polymers, esters thereof and the acid anhydrides thereof as disclosed in U.S. Pat. No. 3,362,819. Specific examples of high molecular weight acid substances are copolymers of maleic anhydride with a vinyl monomer such as ethylene, vinyl acetate or vinylmethylether, the n-butyl half ester thereof, copolymers of butyl acrylate with acrylic acid, and cellulose acetate acid phthalate. The neutralizing layer can further contain a polymer such as cellulose nitrate or polyvinyl acetate, and a plasticizer as disclosed in U.S. Pat. No. 3,557,237. Further, the neutralizing layer can be hardened by crosslinking reaction with a polyfunctional aziridine compound, epoxy compound, etc. The neutralizing layer is arranged in the image-receiving element and/or the light-sensitive element, and preferably is provided between the image-receiving layer and the support of the image-receiving element. As described in German Pat. application (OLS) No. 2,038,254, the acid substance can be incorporated into the film unit in the form of microcapsules.

The neutralizing layer and the acid substance-containing layer are preferably isolated from the processing solution layer to be spread by a layer for controlling the neutralizing speed (hereinafter referred to "neutralization rate-controlling layer"), which acts to prevent the density of transferred images from being reduced before development of the silver halide and formation of diffusion transfer images and to maintain the high pH of the processing solution until the desired development and transfer are completed. In a preferred embodiment of the invention, the image-receiving portion is composed of a support, a neutralizing layer, a neutralization rate-controlling layer, and a mordant layer (image-receiving layer), in a superposed relationship. The neutralization rate-controlling layer contains, as a main component, a polymer such as gelatin, polyvinyl alcohol, polyvinylpropylether, polyacrylamide, hydroxypropylmethyl cellulose, isopropyl cellulose, partially polyvinyl butyral, partially hydrolized polyvinyl acetate, or a copolymer of beta-hydroxyethyl methacrylate and ethyl acrylate. The polymer is advantageously hardened by a crosslinking reaction with an aldehyde compound such as formaldehyde or an N-methylol compound. It is preferred that the thickness of the neutralization rate-controlling layer be about 2 to 20 microns.

The processing solution used in the invention is a liquid containing the processing components necessary for the development of the silver halide emulsion and for formation of diffusion transfer dye images. A major portion of the solvent of the processing solution is water and a hydrophilic solvent such as methanol or methyl cellosolve is often present. The processing solution contains an alkali in the amount sufficient to maintain the pH necessary for developing the emulsion layer and to neutralize the acid generated in the steps of development and formation of color dye images. The acid can be a hydrohalic acid such as hydrobromic acid, or a carboxylic acid such as acetic acid. The alkali processing solution can contain lithium hydroxide, sodium hydroxide, potassium hydroxide, calcium hydroxide, tetramethylammonium hydroxide, sodium carbonate, trisodium phosphate, diethylamine, and other alkali metal salts, alkali earth metal salts and amines. Preferably, the processing composition contains a hydrophilic polymer such as polyvinyl alcohol, hydroxyethyl cellulose or sodium carboxymethyl cellulose. These polymers provide a viscosity of more than 1 poise, preferably several hundred (500 to 600) poises to 1000 poise to the processing composition, whereby the processing composition is uniformly spread in the processing step and a non-flowing layer of the composition is formed to assist the adhering of the layers in the film unit when an aqueous solvent is transferred to the light-sensitive element and the image-receiving element to concentrate the processing composition. The polymer layer takes part in controlling the transfer of the coloring component to the image-receiving layer and in protecting the color change of the images after the completion of the diffusion transfer of the image.

In some cases, the processing composition contains a light-interrupting substance such as carbon black to protect the silver halide emulsion from fogging by light in the processing step, and a desensitizer as disclosed in U.S. Pat. No. 3,579,333.

In the color diffusion transfer process, the photographic light-sensitive material is developed in the presence of a diffusible onium compound. Examples of such onium compounds are quarternary ammonium compounds, quarternary phosphonium compounds and quarternary sulfonium compounds. Particularly useful onium compounds include 1-benzyl-2-picolinium bromide, 1-(3-bromopropyl)-2-picolinium-p-toluene sulfonate, 1-phenylethyl-2-picolinium bromide, 2,4-dimethyl-1-phenylethylpyridinium bromide, alphapicoline-beta-naphthoylmethyl bromide, N,N-diethylpiperidinium bromide, dodecyldimethylsulfonium-p-toluenesulfonium, phenylethylphosphonium bromide, etc. The onium compound is preferably incorporated into an alkaline processing composition. The amount of the onium compound is about 2 to 15 wt% based on the total weight of the processing composition. By developing the element in the presence of the onium compound, the image quality of the transferred images is remarkably increased. Other onium compounds are disclosed in U.S. Pat. Nos. 3,411,904 and 3,173,786. The processing composition can further contain a development controlling agent such as benzotriazole.

The invention will be illustrated in greater detail by reference to the following synthesis examples and Examples.

SYNTHESIS EXAMPLE 1 a. Synthesis of the Methyl Ester of 2-Cyano-2-furoyl Acetic Acid

In 700 ml of anhydrous tetrahydrofuran, 73 g of sodium hydroxide was suspended and into the suspension with stirring at 5° C or lower temperature, 93 g of methyl cyanoacetate dissolved in 750 ml of dried tetrahydrofuran was added in a dropwise manner. After 20 minutes, 123 g of 2-furoyl chloride dissolved in 100 ml of anhydrous tetrahydrofuran was added in a dropwise manner at a temperature lower than 12° C with stirring, whereby foam was generated and crystals separated. After 3 hours, 50 ml of methanol was added to the resulting solution, and then the mixture was introduced into 2 liters of ice water containing 60 ml of acetic acid. The separated crystals were recrystallized from ethanol to obtain 110 g of the compound having a melting point of 133° C.

b. Synthesis of 2-Cyanoacetylfuran

A mixture of 40 g of 2-cyano-2-furoyl acetic acid methyl ester obtained in the above a), 20 g of sodium hydroxide and 200 ml of water was heated to 70° C for 40 minutes, and after cooling, the mixture was neutralized with hydrochloric acid. The formed crystals were washed with water and recrystallized from ethanol to obtain 19 g of the compound having a melting point of 76° to 77° C.

c. Synthesis of 3-Oxo-3-(2-furanyl)-2-[4-(2-hydroquinonylethyl) phenylazo]-propionitrile By utilizing 350 ml of water, 20 ml of 35% hydrochloric acid and 8 g of sodium nitrite, 35 g of 4-(2,5-bisacetoxyphenylethyl)aniline hydrochloride disclosed in Japanese Pat. Publication No. 444/63 was diazotized. Then, the mixture was neutralized with sodium acetate to adjust the pH of the solution to 6, and the mixture cooled with ice water was added dropwise at 5° C or less to liquid comprising of 13.5 g of 2-cyanoacetylfuran and 300 ml of ethanol. The resulting resinous substance was washed with water and decanted 2 times and then stirred in water, whereby crystals were formed. In 400 ml of ethanol, 40 g of the crude product obtained by filtering the crystals and drying the crystals was suspended. To the suspension, a liquid comprising 40 g of potassium hydroxide and 100 ml of water was added under vacuum, and the mixture heated for several minutes at 60° C, and then rapidly cooled. To the cooled mixture, 200 ml of a 35% hydrochloric acid aqueous solution was added to form crystals which were filtered, washed with water and recrystallized from 250 ml of ethanol to provide 19.5 g of the compound having a melting point of 175° to 178° C.

d. Quinonation of the Hydroquinone Portion

In a mixture of 11 g of p-benzoquinone and 100 ml of acetone, 19.5 g of the compound obtained in step c) was refluxed and after 30 minutes crystals began to be formed. After one hour, the crystals were filtered and washed with acetone to obtain 14.5 g of a quinone form having a melting point of 190° to 195° C.

e. Acetylation of the Enol

After 14.5 g of the quinone form obtained in step d) was refluxed under heating for 3 hours together with 45 ml of isopropenyl acetate, 300 ml of ethylene chloride and 0.5 ml of conc. sulfuric acid, ethylene chloride was vaporized under reduced pressure and then the residue was recrystallized from benzene to obtain 12 g of the product having a melting point of 169° to 172° C.

f. Synthesis of Compound 1

In 400 ml of ethyl acetate, 10 g of the acetyl form obtained in step e) was dissolved, and to the solution, a mixture of 22 g of N,N-diethylhydroxylamine and 600 ml of ethyl acetate was added. The mixture was stirred for 2 hours at normal temperature, was washed 2 times with 300 ml of a 2.5% hydrochloric acid aqueous solution and then was washed with 200 ml of water. Further, the mixture was washed 3 times with 100 ml of a saturated aqueous solution of sodium chloride, and it was filtered by adding 60 g of sodium sulfate and 3 g of activated charcoal. From the filtered liquid, the solvent was vaporized. Then, a small amount of benzene was added to the residue to form crystals which were then filtered and the crystals were recrystallized from 200 ml of ethyl acetate to provide 7 g of the compound having a melting point of 184° to 186° C.

SYNTHESIS EXAMPLE 2 a. Synthesis of 3-Oxo-3-(2-cumaronyl)-2-[4-(2-quinonylethyl)-phenylazo]-propionitrile In 160 ml of ice water containing 145 ml of a 35 wt% hydrochloric acid aqueous solution, 40.5 g of 4-(2,5-dihydroxyphenethyl)aniline was dissolved and 2 ml of 2-ethyl-1-hexanol was added to the solution as a defoaming agent. To the solution, a liquid composed of 41.0 g of sodium nitrite and 300 ml of ice water was added dropwise over a period of 15 minutes at −3° C to 0° C. After the addition of the liquid, the mixture was stirred for an additional 90 minutes, and the pH of the mixture was adjusted to 4 to 5 by adding sodium acetate thereto. To the mixture, 2 l of an ethanol solution containing 30 g of 2-(2-cyanoacetyl)cumarone, 100 ml of an aqueous solution containing 9.3 g of sodium hydroxide, and about 1 kg of crushed ice were added with stirring. After stirring for one hour, the crystals formed were filtered, washed with 300 ml of ethanol and recrystallized from 300 ml of acetone to obtain 28.5 g of the product having a melting point of 169° to 172° C.

b. Synthesis of 3-Acetoxy-3-(2-cumaronyl)-2-[4-(2-quinonylethyl) phenylazo]-acrylonitrile In 200 ml of 1,2-dichloroethane, 17 g of the compound obtained in step a) and 52 ml of isopropenyl acetate were dissolved, and after adding 1 ml of conc. sulfuric acid to the mixture, the mixture was refluxed for 8 hours under heating on steam bath. The resulting mixture was filtered to remove the tarry material, the filtered liquid was concentrated and the crystals formed were recrystallized from 1,2-dichloroethane to obtain 13.7 g of the product having a melting point of 190° to 192° C.

c. Synthesis of Compound 2

In 500 m of 1,2-dichloroethane, 13 g of the compound obtained in step b) was dissolved and then 6.5 g of 2,5-tertbutylhydroquinone was added at room temperature. The mixture was stirred for 40 minutes and was allowed to stand to form crystals which were filtered and recrystallized from 1,2-dichloroethane to obtain 8.5 g of the product having a melting point of 215° to 217° C.

SYNTHESIS EXAMPLE 3 a. Synthesis of 2-Acetyl-5-methoxycumarone

In 120 ml of ethanol, 36 g of 2-hydroxy-5-methoxybenzaldehyde was added, further 15 g of potassium hydroxide and 60 ml of ethanol were added and the mixture was refluxed for 30 minutes on a steam bath. After cooling, 22.2 g of chloroacetone was added dropwise, and the mixture was heated for 15 minutes at 50° to 60° C. To the resulting mixture, about 300 ml of water was added to form crystals, which were then filtered and recrystallized from n-hexane to obtain 25 g of the compound having a melting point of 86° to 87° C.

b. Synthesis of 2-Bromoacetyl-5-methoxycumarone

In 200 ml of ethanol, 60 g of 2-acetyl-5-methoxycumarone was dissolved. To the mixture, 3 ml of acetic acid and further 50 g of bromine was added dropwise at 55° to 65° C. Then, the mixture was allowed to stand for 30 minutes with stirring slowly and then 150 ml of water was added and the mixture was cooled to crystallize the separated oil material. Thus obtained crystals were washed with a 60% ethanol aqueous solution and recrystallized from an 80% ethanol aqueous solution to provide 50 g of the product having a melting point of 93° to 95° C.

c. Synthesis of 2-Cyanoacetyl-5-methoxycumarone

In 45 ml of water, 18.6 g of potassium cyanide was dissolved. With stirring the solution, a solution of 36 g of 2-bromoacetyl-5-methoxycumarone and 250 ml of ethanol was added dropwise at 65° to 75° C. The mixture was stirred for 1 hour and then cooled in ice water. Thus crystals obtained were filtered and then added to 250 ml of water and to the mixture, 15 ml of acetic acid was added to form the crystals. The crystals were filtered and recrystallized from benzene to obtain 18 g of the product having a melting point of 164° to 165° C.

d. Synthesis of Compound 6

Using the same method as in the preparation of Compound 2, 4-(2,5-dihydroxyphenethyl)aniline was diazotized, coupled, acetylated and then reduced in the quinone portion to provide the product which was then recrystallized from acetone to obtain the compound having a melting point of 235° to 237° C.

SYNTHESIS EXAMPLE 4 a. Synthesis of Ethyl o-Acetylphenoxyacetate

A mixture of 136 g of o-hydroxyacetophenone, 167 g of ethyl bromoacetate and 205 g of potassium carbonate was refluxed in 3 l of acetone for 6 hours under heating with stirring. The insoluble materials were filtered from the reaction mixture and the acetone was evaporated from the filtrate. Further, the mixture was distilled to obtain a fraction having a boiling point of 132° C/2 mmHg which was then recrystallized from ligroin to obtain 150 g of the product.

b. Synthesis of Ethyl 3-Methylcumarone-2-carboxylate

A 1.6 l of ethanol solution containing 150 g of the product obtained in step a) and 21g of metallic sodium was refluxed under heating for 2 hours. Then, after evaporating about 0.7 l of ethanol, 9 l of water was added to remove a small amount of insoluble materials, and the filtrate was adjusted to acid by adding a 35 wt% hydrochloric acid solution. The thus formed precipitate was filtered and recrystallized from benzene to obtain 51 g of 3-methylcumarone-2-carboxylic acid, to which 27 g of methanol, 5.2 ml of conc. sulfuric acid and 85 ml of ethylene chloride were added and refluxed for 13 hours under heating. The mixture was washed with a saturated aqueous solution of sodium chloride and after evaporating the solvents, was recrystallized from ligroin to 49 g of the ester having a melting point of 64° to 66° C.

c. Synthesis of 2-Cyanoacetyl-3-methylcumarone

A mixture of 28.5 g of ethyl 3-methylcumarone-2-carboxylate, 7.8 g of acetonitrile, 8.1 g of sodium methoxide and 150 ml of chlorobenzene were reacted for 12 hours at 90° to 100° C. To the mixture, 0.8 l of water and 100 ml of ethylene chloride were added and the mixture was shaken. The separated water layer was adjusted to a pH of 5 and the formed precipitate was recrystallized from a mixture of ligroin and benzene (20 : 1 by volume) to obtain 10 g of the product.

d. Synthesis of Compound 8

Using the same method as in the preparation of Compound 1, 4-(2,5-bis-acetoxyphenylethyl)aniline hydrochloride and the product obtained in step c) were diazo-coupled, and after deacetylation of the dye obtained, the product thereof was oxidized to the quinone form, acetylated in the carbonyl portion and then reduced in the quinone portion to obtain the compound having a melting point of 195° to 197° C.

EXAMPLE 1

On a cellulose triacetate film having coated thereon a gelatin subbing layer, the following layers were coated in order to provide a Light-Sensitive Element (I).

1. Yellow Dye Developer Layer

In a mixture of 1 part of N,N-diethyllaurylamide and 4 parts of cyclohexanone, 1 part of Compound 3, i.e., 3-acetoxy-3-(2-cumaronyl)-2-[3-(2-hydroquinonylethyl)phenylazo]-acrylonitrile was dissolved. The solution was dispersed in an aqueous solution of gelatin together with sodium n-dodecylbenzene sulfonate, and then was coated so that the amount of the dye developer was 1.4 g/m², the amount of gelatin was 2.4 g/m² and the amount of N,N-diethyllaurylamide was 1.4 g/m².

2. Blue-Sensitive Emulsion Layer

A blue-sensitive silver iodobromide emulsion layer containing 2 mol% of silver iodide was coated so that the amount of silver was 3.5 g/m² and the amount of gelatin was 4.0 g/m².

3. Protective Layer

In a mixture of 1 part of tri-o-cresylphosphate and 1.5 parts of ethyl acetate, 1 part of 4′-methylphenylhydroquinone was dissolved. The solution was dispersed in an aqueous gelatin solution together with sodium n-dodecylbenzene sulfonate, and then coated so that the amount of 7′-methylphenylhydroquinone was 0.20 g/m², the amount of gelatin was 0.6 g/m² and the amount of tri-o-cresylphosphate was 0.20 g/m². As the hardening agent, mucochloric acid was used.

As a comparative sample to Light-Sensitive Element (I), Light-Sensitive Element (II) was prepared which was the same as Light-Sensitive Element (I) except that the yellow dye developer layer had the following composition.

Yellow Dye Developer Layer of Light-Sensitive Element (II)

In a mixture of 2.5 parts of N,N-diethyllaurylamide and 2.5 parts of cyclohexanone, 1 part of 1-phenyl-3-(N-n-hexylcarboxyamide)-4-[4-(2-hydroquinonylethyl)-phenylazo]-5-pyrazolone (comparative dye developer) was dissolved. The solution was dispersed in an aqueous gelatin solution together with sodium n-dodecylbenzene sulfonate, and then coated so that the amount of dye developer was 1.4 g/m², the amount of gelatin was 2.4 g/m² and the amount of N,N-diethyllaurylamide was 3.5 g/m².

Then, the following layers were coated in order on a polyethylene film to provide the image-receiving element.

1. Acid Polymer Layer

A 20% methyl ethyl ketone solution of the butyl half-ester of a maleic anhydride-vinylmethyl ether copolymer having a copolymerization molar ratio of 1:1 and an average molecular weight of about 100,000 was coated in a dry thickness of 20 microns.

2. Neutralization Rate-Controlling Layer

In a mixture of 3 parts of acetone and 1 part of water, 1 part of 2-hydroxyethyl methacrylate was dissolved and then coated in a dry thickness of 7 microns.

3. Image-Receiving Layer

In 150 parts of water containing 0.5 part of glacial acetic acid, 1 part of poly-4-vinylpyridine, 2 parts of polyvinyl alcohol having a saponification degree of 98% and a polymerization degree of 1,800 and 0.05 part of 1-phenyl-5-mercaptotetrazole were dissolved. The solution was coated so that the amount of poly-7-vinylpyridine was 3.2 g/m², the amount of polyvinyl alcohol was 3.2 g/m² and the amount of 1-phenyl-5-mercaptotetrazole was 0.16 g/m².

Light-Sensitive Elements (I) and (II) each was exposed from the side of support through a step wedge to a tungsten lamp of 20 6.M.S. and a color temperature of 2,854° K, and then was contacted with the image-receiving element while the following processing solution was spread in the amount of 1.5 cc per 100 cm² of the image-receiving element. After being in contact for about 1 minute, the image-receiving element was stripped from the light-sensitive element and then was sufficiently washed with water. On the image-receiving element, yellow dye images corresponding to the exposure amounts were transferred.

| Processing Solution: | |
|---|---|
| Water | 100 cc |
| Potassium Hydroxide | 11.2 g |
| Hydroxyethyl Cellulose | 4.0 g |
| Benzotriazole | 3.5 g |
| Potassium Thiosulfate | 0.5 g |
| Lithium Nitrate | 0.5 g |
| Zinc Nitrate | 0.5 g |
| N-Benzyl-α-picolinium bromide | 2.3 g |

When the transmitted densities of the transferred yellow dye images were measured using a blue filter, the $D_{max}$ and $D_{min}$ of Light-Sensitive Element (I) were 1.09 and 0.14, respectively, and the $D_{max}$ and $D_{min}$ of Light-Sensitive Element (II) were 0.90 and 0.10, respectively.

Figure 2:
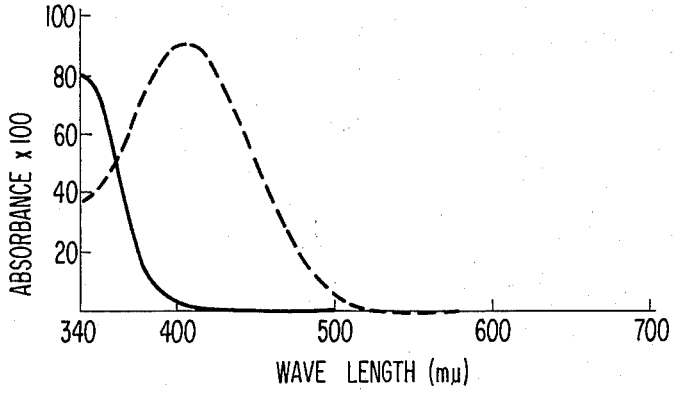
FIG. 2 shows the spectral absorption curves with regard to Compound 8 similar to FIG. 1 above, in which the amount of Compound 8 was 1.90 mg per 100 ml of acetone.

In the case of contacting Light-Sensitive Element (I) with the image-receiving element for 45 seconds in the presence of the processing solution, the spectral absorption curve of the dye images, which was measured using the transmitting density, was as shown in FIG. 2.

Then, Light-Sensitive Elements (I) and (II) each was exposed from the opposite side of the support in the similar conditions and processed the same as above, and the densities were measured. The sensitivity reduction in the exposure from the side of the support to the exposure from the opposite side of the support was $-\Delta$ log. E = 0.4 in Light-Sensitive Element (I) and $-\Delta$ log. E = 2.4 in Light-Sensitive Element (II). That is, the sensitivity reduction of Light-Sensitive Element (I) was superior to that of Light-Sensitive Element (II).

Figure 3:
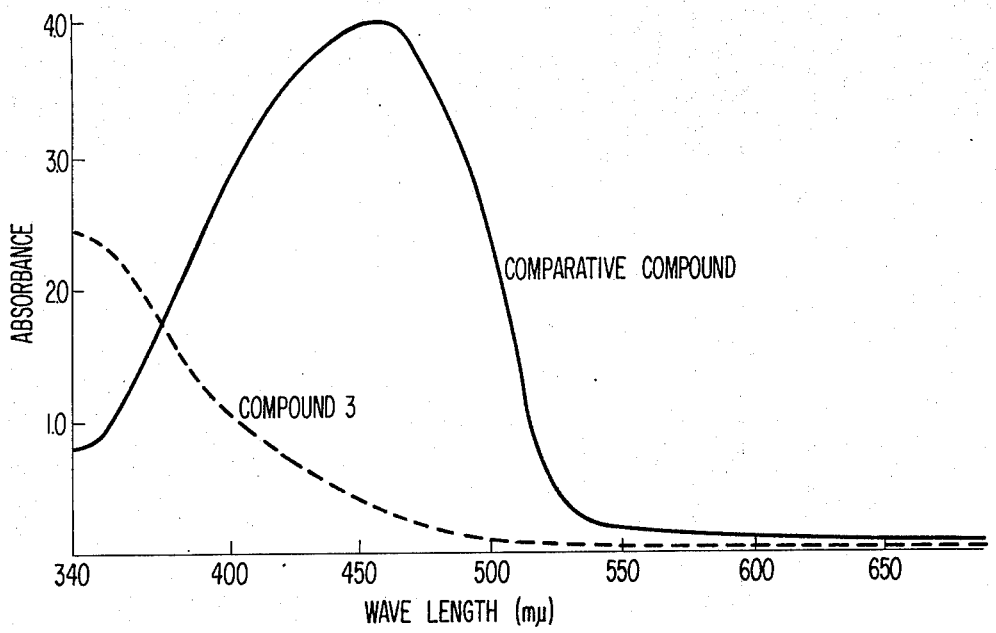
FIG. 3 shows the spectral absorption curves of the dye developer containing Compound 3 (dotted line) and of a comparative dye developer (continuous line).
Figure 4:
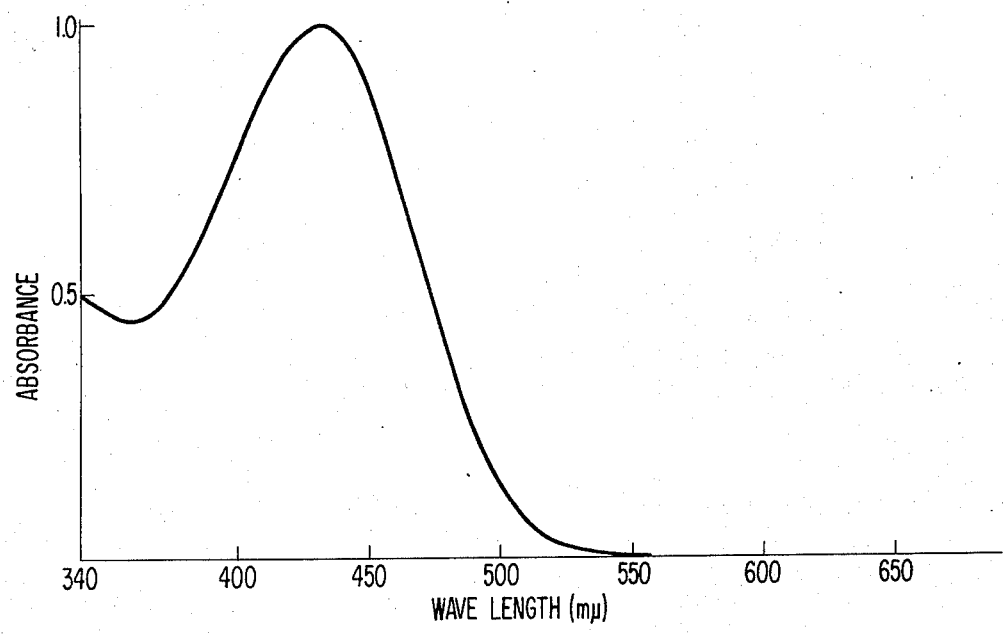
FIG. 4 shows the spectral absorption curve showing Compound 3 transferred to the image-receiving element.

Further, in order to compare the absorption due to the dye developer layer before the light-sensitive element was exposed, each dye developer was coated on a cellulose acetate film having coated thereon a gelatin subbing layer and the spectral absorption thereof was measured using the transmitting density. The results obtained are shown in FIG. 3. As is apparent from FIG. 3, the absorption of Compound 3 was shifted to a shorter wave range than that of the comparative dye developer, and therefore it can be understood that the spectral sensitivity of the associated blue-sensitive emulsion is hardly influenced by the dye developer of the invention.

EXAMPLE 2

In the case where the same operation was repeated as in Example 1 except that Compound 1 was used instead of Compound 3, the absorption before processing was shifted to a shorter wave range than that after processing. The maximum absorption in the image-receiving element after processing was $\lambda_{max}$ 423 mμ. And, the sensitivity reduction of Compound 1 was $-\Delta$ log. E = 0.5 and was remarkably lower than that of the comparative dye developer in Example 1.

EXAMPLE 3

On a cellulose triacetate film having coated thereon a gelatin subbing layer, the following layers were coated in order to provide a light-sensitive element.

1. Yellow Dye Developer Layer

After 1 part of Compound 8 was dissolved in a mixture of 1 part of N,N-diethyllaurylamide and 4 parts of cyclohexanone, the solution was dispersed in an aqueous gelatin solution together with sodium n-dodecylbenzene sulfonate, and then was coated so that the amount of the dye developer was 1.5 g/m², the amount of gelatin was 1.7 g/m² and the amount of N,N-diethyllaurylamide was 1.5 g/m².

2. Blue-Sensitive Emulsion Layer

A blue-sensitive silver iodobromide emulsion layer was coated so that the amount of silver was 2.3 g/m² and the amount of gelatin was 1.7 g/m².

3. Intermediate Layer

A gelatin solution was coated so that the amount of gelatin was 3.0 g/m².

4. Magenta Dye Developer Layer

After 1 part of 4-methoxyethoxy-2-[4-(2-hydroquinonylethyl)-phenylazo]-naphthalene-1-acetate was dissolved in a mixture of 1 part of N,N-diethyllaurylamide and 4 parts of cyclohexanone and the solution was dispersed in an aqueous gelatin solution together with sodium n-dodecylbenzene sulfonate, and then coated so that the amount of the dye developer was 1.0 g/m², the amount of gelatin was 1.3 g/m² and the amount of N,N-diethyllaurylamide was 1.0 g/m².

5. Green-Sensitized Emulsion Layer

A green-sensitized silver iodobromide emulsion layer containing 2 mol% of silver iodide and spectrally sensitized with 3,3',9-triethyl-5,5'-diphenyloxacarbocyanine bromide was coated so that the amount of silver was 1.0 g/m² and the amount of gelatin was 0.8 g/m².

6. Intermediate Layer

A gelatin solution was coated so that the amount of gelatin was 3.0 g/m².

7. Cyan Dye Developer Layer

After 1 part of 1-(N-carbophenoxy-N-γ-hydroquinonylpropylamino)-4-γ-hydroquinonylpropylamino-5,8-dihydroxy-9,10-anthraquinone was dissolved in a mixture of 2 parts of N,N-diethyllaurylamide and 4 parts of methylcyclohexanone, the solution was dispersed in an aqueous gelatin solution together with sodium n-dodecylbenzene sulfonate, and then was coated so that the amount of the dye developer was 0.50 g/m², the amount of gelatin was 1.2 g/m² and the amount of N,N-diethyllaurylamide was 0.50 g/m².

8. Red-Sensitized Emulsion Layer

A red-sensitized silver iodobromide emulsion layer containing 2 mol% of silver iodide and spectrally sensitized with 3,3',9-triethyl-5,5'-dichlorothiacarbocyanine iodide was coated so that the amount of silver was 0.50 g/m² and the amount of gelatin was 0.37 g/m².

9. Protective Layer

After 1 part of 4'-methylphenylhydroquinone was dissolved in a mixture of 1 part of tri-o-cresylphosphate and 1.5 parts of ethyl acetate, the solution was dispersed in an aqueous gelatin solution together with sodium n-dodecylbenzene sulfonate, and was coated so that the amount of 4'-methylphenylhydroquinone was 0.45 g/m², the amount of gelatin was 1.3 g/m² and the amount of tri-o-cresylphosphate was 0.45 g/m². The layer was hardened with mucochloric acid.

Then, the following layers were coated on a transparent polyethylene film to provide the image-receiving element.

1. Acid Polymer Layer

A 20% methyl ethyl solution of the butyl half ester of a maleic anhydride-vinylmethyl ether copolymer having a copolymerization molar ratio of 1:1 and an average molecular weight of about 100,000 was coated in a dry thickness of 40 microns.

2. Neutralization Rate-Controlling Layer

In a mixture of 3 parts of acetone and 1 part of water, 1 part of 2-hydroxyethyl methacrylate was dissolved and then coated in a dry thickness of 14 microns.

3. Image-Receiving Layer

An image-receiving layer as described in Example 1 was coated.

The light-sensitive element was exposed from the side of the support through the step wedge to red-, green- and blue light, and then contacted with the image-receiving element in the presence of the following processing solution. The processing solution was spread between the light-sensitive element and the image-receiving element in the amount of 1.0 cc per 100 cm² of the image-receiving element. After development for several minutes, the appearance of red, green and blue images could be observed from the side of the support without stripping the image-receiving element.

| Processing Solution: | |
|---|---|
| Water | 100 cc |
| Potassium Hydroxide | 11.2 g |
| Hydroxyethyl Cellulose | 3.5 g |
| Benzotriazole | 1.5 g |
| N-Phenethyl-α-picolinium bromide | 2.0 g |
| Titanium Dioxide | 50 g |

While the invention has been described in detail and with reference to specific embodiments thereof, it will be apparent to one skilled in the art that various changes and modifications can be made therein without departing from the spirit and scope thereof.

What is claimed is:

1. A light-sensitive material for the diffusion transfer process comprising a support having coated thereon a blue-sensitive silver halide emulsion and an associated yellow dye developer represented by the following general Formula I:

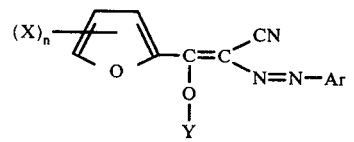

(I)

wherein X is a hydrogen atom, a bromine atom, a nitro group, an acylamino groups, a hydroxyl group or an alkyl group having not more than 4 carbon atoms; *n* is 1, 2 or 3; Y is an acyl group having not more than 4 carbon atoms, and Ar is a mono-aryl group; and wherein an aromatic ring can be condensed in the 4- and 5- positions of the furan ring nucleus; and Ar being directly connected to or being connected through an atom or an atomic grouping to a hydroquinone developer, or ester precursor thereof, for silver halide, a green-sensitive silver halide emulsion and an associated magenta dye developer, and a red-sensitive silver halide emulsion and an associated cyan dye developer.

2. The light-sensitive material as claimed in claim 1, wherein said yellow dye developer is positioned at the exposure side to the corresponding blue-sensitive silver halide emulsion layer.

3. The light-sensitive material as claimed in claim 1, wherein the blue-sensitive silver halide emulsion and the associated yellow dye developer are present in the same layer and the blue-sensitive silver halide emulsion is capable of being spectrally sensitized.

4. The light-sensitive material as claimed in claim 1, wherein the yellow dye developer is as described in claim 1 and including a container retaining a processing solution for the light-sensitive material and containing a light-reflecting agent.

5. The light-sensitive material as claimed in claim 4, wherein said light-reflecting agent is titanium dioxide.

6. The light-sensitive material as claimed in claim 1, wherein the yellow dye developer is as described in claim 1 and including an image-receiving element for the dye images transferred on development of said light-sensitive material and having a neutralizing layer and a mordant layer in combination, said mordant layer being closer to said light sensitive material than said neutralizing layer.

7. The light-sensitive material as claimed in claim 6, wherein the mordanting agent has a poly-4-vinylpyridine structure.

8. The light-sensitive material as claimed in claim 1, wherein said yellow dye developer is

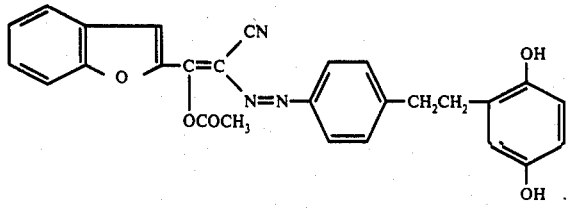

9. The light-sensitive material as claimed in claim 1, wherein the yellow dye developer is

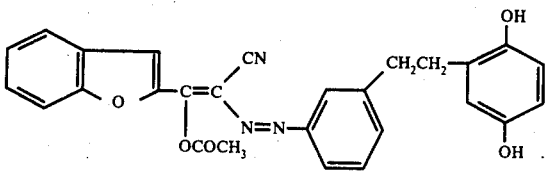

10. The light-sensitive material as claimed in claim 1, wherein said yellow dye developer is

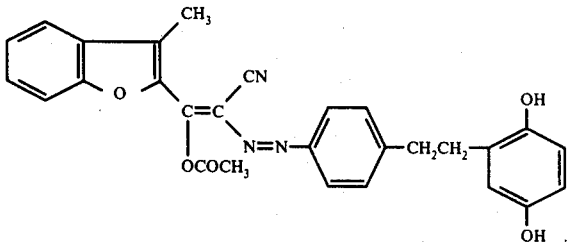

* * * * *